United States Patent [19]

McKee et al.

[11] 4,315,259

[45] Feb. 9, 1982

[54] SYSTEM FOR OPERATING A DISPLAY PANEL HAVING MEMORY

[75] Inventors: Joseph E. McKee, Annandale, N.J.; James Y. Lee, Sugar Land, Tex.

[73] Assignee: Burroughs Corporation, Detroit, Mich.

[21] Appl. No.: 200,160

[22] Filed: Oct. 24, 1980

[51] Int. Cl.[3] ..... H05B 37/00

[52] U.S. Cl. ..... 340/799; 340/769; 340/771; 340/792; 315/169.4; 313/188

[58] Field of Search ..... 340/713, 714, 769, 771, 340/773, 775, 779, 792, 798, 799; 315/169.4; 313/188

[56] References Cited

U.S. PATENT DOCUMENTS

| | | | |
|---|---|---|---|
| 3,499,167 | 3/1970 | Baker et al. | 340/779 |
| 3,559,190 | 1/1971 | Bitzer et al. | 313/201 |
| 3,921,021 | 11/1975 | Glaser et al. | 340/773 |
| 4,065,699 | 12/1977 | Baird | 340/773 |

OTHER PUBLICATIONS

Fujitsu, Sci. & Technol. (Japan), vol. II, No. 2, 6/1975, pp. 81–98.

*Primary Examiner*—Alvin H. Waring
*Attorney, Agent, or Firm*—Kevin R. Peterson; Robert A. Green; David G. Rasmussen

[57] ABSTRACT

A system for operating a memory display panel comprising a gas-filled envelope having an array of D.C. gas discharge cells and an array of quasi A.C. gas discharge cells, there being one A.C. cell for each D.C. cell. The A.C. cells are the display cells of the panel and include electrode means which receive sustainer signals for sustaining glow therein, and the D.C. cells are operated in a scanning fashion to address selected A.C. cells in which glow is to be displayed.

The system includes electronic circuitry for performing the above-mentioned operations of driving the D.C. cells, generating sustaining signals for the A.C. cells, and energizing the A.C. cells in accordance with input data information. Appropriate timing control circuits are also provided.

4 Claims, 5 Drawing Figures

SYSTEM FOR OPERATING A DISPLAY PANEL HAVING MEMORY

BACKGROUND OF THE INVENTION

Gas-filled display panels have been known for many years; examples of such panels are PANAPLEX panels and SELF-SCAN panels, both of which are made and sold by Burroughs Corporation. These panels are commercially successful, and they operate well, but they do not have memory; that is, a message or character cannot be introduced into these panels by the application of a signal and then retained after that signal has terminated. For a long time, a need has existed for a display panel having the simplicity and reliability of the PANAPLEX and SELF-SCAN panels and also having memory, because of the reliability and high brightness that such a panel would exhibit and the simplicity of its operating circuitry.

One type of prior art panel which has memory is illustrated in U.S. Pat. No. 3,559,190 of Bitzer et al. This panel is an A.C. panel; that is, it employs an A.C. signal applied to electrodes that are insulated from the gas in the panel. The Bitzer et al panel has a single layer of cells in an internal cellular construction. Because of the isolation afforded by the cellular construction, the individual cells of the panel have a serious first electron problem, and many of the cells are consequently difficult to turn on. A modification of the Bitzer et al panel is illustrated in U.S. Pat. No. 3,499,167 of Baker et al, which has an open construction and solves the first electron problem. However, Baker et al has a problem with cell definition, and the electronic circuitry it requires is complex and expensive.

Another panel having memory and having considerable potential promise is described in U.S. Pat. No. 3,921,021 of Glaser et al. The present invention is an improvement over the Glaser et al panel, involving a different mode of operation and simpler construction and operating circuitry.

The most promising memory display panel disclosed in recent years is described and claimed in copending application Ser. No. 051,313, filed June 22, 1979 and incorporated herein by reference. This display panel has an array of quasi A.C. display cells and an array of D.C. cells, the D.C. cells being operable to select and address each of the A.C. display cells, to either establish glow in selective display cells or erase glow selectivity from those cells, by means of a controlled interaction between selected A.C. and D.C. cells. Once the glow is established, it is sustained, until it is erased, by the applied A.C. signal.

Electronic systems are known for operating the prior art panels described above; however, none of these systems is suitable for operating the new panel described in the aforementioned application. A system for operating this new panel is described and claimed herein.

DESCRIPTION OF THE INVENTION

The display panel described herein and in application Ser. No. 051,313 utilizes structural features of SELF-SCAN panels of the type made and sold by Burroughs Corporation.

Figure 1:
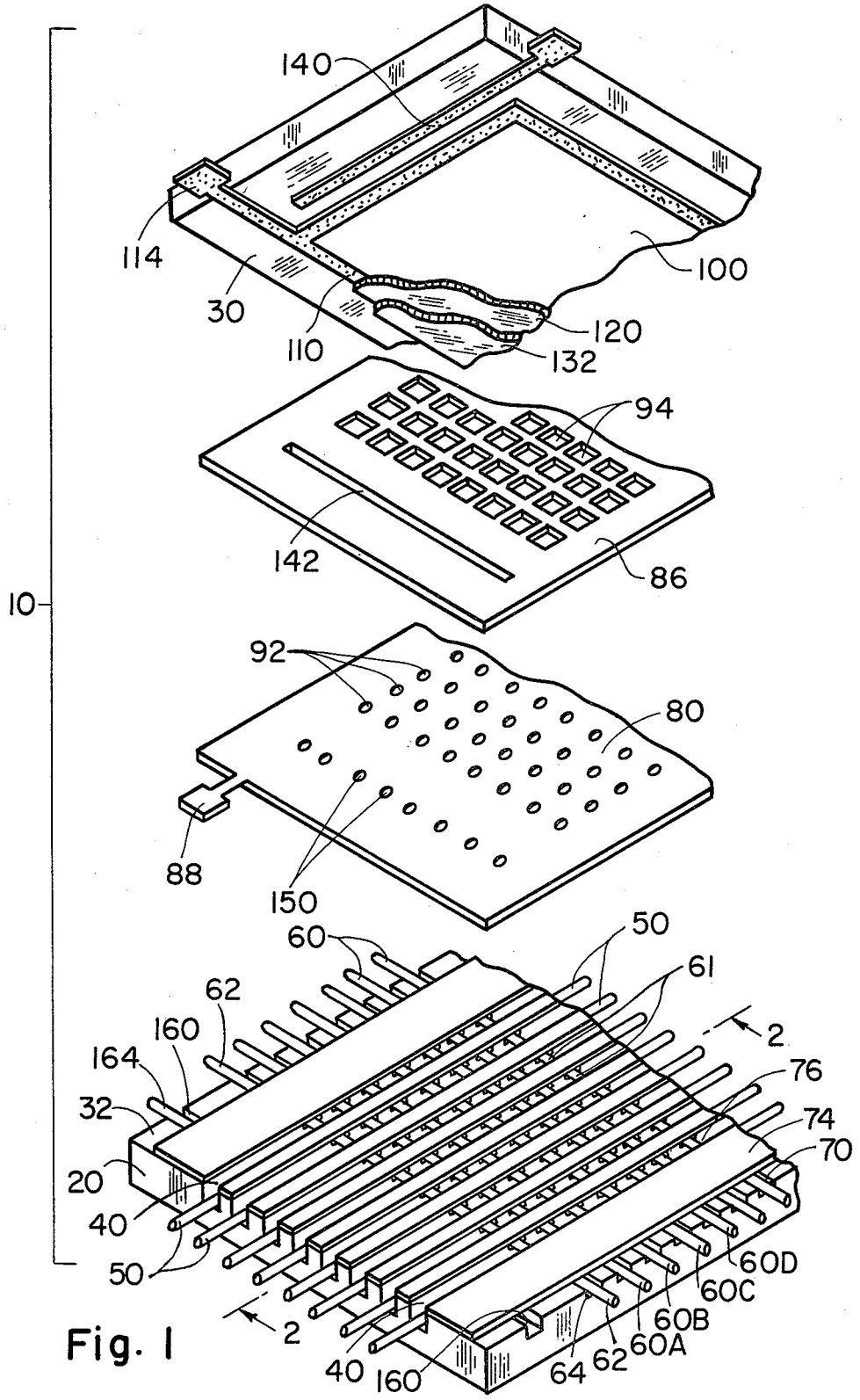
FIG. 1 is a perspective exploded view of a display panel operated according to the invention.

A display panel 10 of the type described in application Ser. No. 051,313 includes a gas-filled envelope made up of an insulating base plate or substrate 20 and a glass face plate 30, which is shown tilted up and to the left in FIG. 1 to present a view of its inner surface. These plates are hermetically sealed together along a closed periphery which encloses the various gas-filled cells and operating electrodes of the panel. The base plate has a top surface 22 in which a plurality of relatively deep parallel slots 40 are formed and in each of which a scan/address anode electrode, for example a wire 50, is seated and secured.

Figure 2:
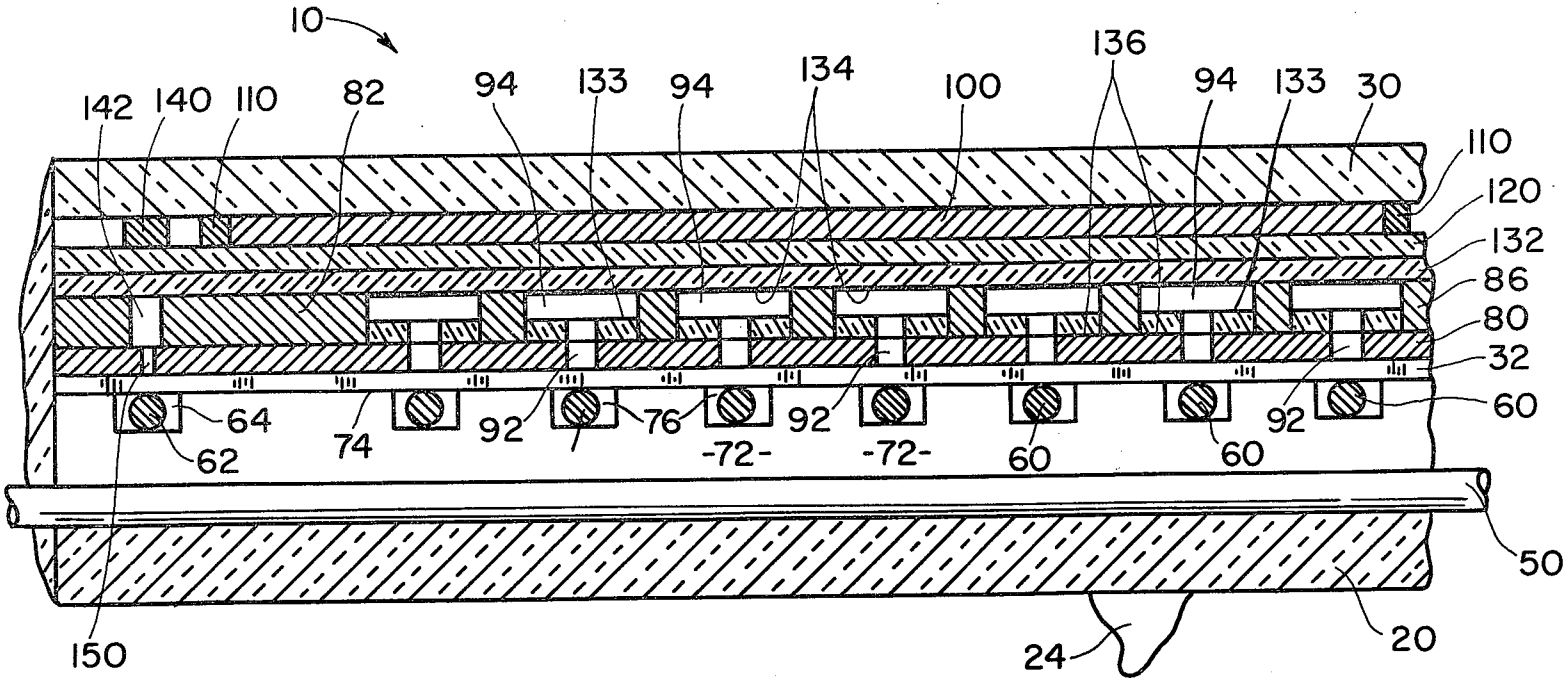
FIG. 2 is a sectional view through the panel of FIG. 1 along lines 2—3, with the panel shown assembled.

A plurality of scan cathode electrodes in the form of wires 60 are seated in relatively shallow slots 70 in the top surface of the base plate. The slots 70 and scan cathodes 60 are disposed transverse to the slots 40 and scan anodes 50, and each crossing of a scan cathode 60 and a scan anode 50 defines a scanning cell 72 (FIG. 2). It can be seen that the anodes 50 and cathodes 60 form scanning cells which are arrayed in rows and columns. More specifically, the cathode portions 61, the underlying portions of anodes 50, and the intermediate gas volumes define the scanning cells.

The scan cathodes 60A, B, C, etc., form a series of cathodes which can be energized serially in a scanning cycle, with cathode 60A being the first cathode energized in the scanning cycle.

A reset cathode wire 62 is disposed in a slot 64 in the top surface of the base plate adjacent to the first scan cathode 60A, so that, when it is energized, it provides excited particles for cathode 60A at the beginning of a scanning cycle to be described. Where the reset cathode crosses each scan anode 50, a reset cell is formed, and the crossing of all of the scan anodes by the reset cathode provides a column of reset cells. These reset calls are turned on or energized at the beginning of each scanning cycle, and they expedite the turn-on of the first column of scanning cells associated with cathode 60A.

The panel 10 includes a keep-alive arrangement which is described below and in copending application Ser. No. 108,805, filed Dec. 31, 1979, and incorporated herein by reference. Copending Holz application Ser. No. 113,095, filed Jan. 17, 1980 describes a method for providing cathodes 60 in panel 10, and this application is also incorporated herein by reference.

In the panel 10, it is desirable that the cathodes 60, or at least the portions 61 thereof which are disposed in the scanning cells, be spaced uniformly from an electrode 80 disposed above the cathodes and described below. It is also desirable to provide means for preventing the spread of cathode glow from the operating portions 61 of the cathodes to the intermediate portions. These conditions may be satisfied by providing a thin slotted insulating sheet 74 on the top surface of the base plate 20.

The portions of the panel described up to this point comprise the base plate assembly. This is the D.C. portion and the scanning and addressing portion of the panel 10.

Adjacent to the base plate assembly is the second portion of the panel which is a quasi A.C. assembly; that is, it includes A.C. and D.C. features. This portion of the panel includes an electrode in the form of a thin metal plate 80 having an array of rows and columns of relatively small apertures 92, each overlying one of the scanning cells. The plate 80 is positioned close to cathodes 60 and may be seated on insulating sheet or layer 74, if this is provided, or directly on the top surface of the base plate 20.

Adjacent to plate 80, and preferably in contact with the upper surface thereof, is an apertured plate or sheet 86 having rows and columns of apertures 94 which are considerably larger than apertures 92. The apertures 94 comprise the display cells of panel 10. The sheet 86 may be of insulating material, or it may be of metal, and, if it is of metal, the plates 80 and 86 may be made in one piece, if desired and if feasible. Plates 80 and 86 are provided with tabs 88 to which external contact can be made.

The quasi A.C. assembly also includes a face plate assembly which includes a single large-area transparent conductive electrode 100 on the inner surface of the plate 30. A narrow conductor 110, which outlines and reinforces the electrode layer 100 in conductive contact, serves to increase its conductivity, if necessary. The conductor 110 includes a suitable tab portion 114, to which external connection can be made. The large-area electrode 100 is of sufficient area to overlie the entire array of display cells 94 in plate 86. An insulating coating 120 of glass or the like covers electrode 100.

If the material of insulating coating 120 provides stable electrical operating characteristics and it does not contain materials which adversely affect panel operation, it need not be coated. However, it may be desirable to coat the glass layer 120 with a dielectric layer 132 of magnesium oxide, thorium oxide, or the like.

In panel 10, the apertures 94 in plate 86 comprise display cells, and, as can be seen in FIG. 2, each display cell has one end wall 134 formed by a portion of insulating layer 132, and an opposite end wall 136 formed by a portion of the top surface of plate 80. To provide cell uniformity and to minimize sputtering, a coating of the material of layer 132 should also be provided on the base or lower wall 136 of each display cell 94, such as the layer 133 shown in FIG. 2.

At the present time, it appears that optimum operation of the panel is achieved if the apertures or cells 94 are unsymmetrical in that insulating layers 120 and 132 together have a thickness greater than layer 133. Indeed, layer 133 may even be thinner than layer 132. Thus, the lower end wall 136 of each cell 94 will have a very high capacitance coupling to the cell, and layer 133 will consequently tend to form only a minimal wall charge in the operation described below. In one mode of construction, both layer 132 and layer 133 may be formed by an evaporation process, and layer 133 may be so thin that it is not completely continuous, which is a desirable quality. In any case, however, the character of this wall of the cell is affected by the aperture 92 in the metal plate 80.

The glass filling in panel 10 is preferably a Penning gas mixture of, for example, neon and a small percentage of xenon, at a pressure of about 400 Torr. When the panel has been constructed and evacuated, the gas filling is introduced through a tubulation 24 secured to base plate 20 (FIG. 2), or a non-tubulated construction can be employed.

The keep-alive arrangement, in panel 10 (see Ser. No. 108,805), includes an A.C. electrode 140 in the form of a line-like conductive film or layer of opaque metal, such as silver, provided on the inner surface of the face plate 30 adjacent to one edge of the transparent conductive electrode 100. The A.C. keep-alive electrode 140 is positioned so that, in the completed panel, it overlies the column of reset cells and reset cathode 62, to which it supplies excited particles. The A.C. keep-alive electrode 140 is covered by the insulating layers 120 and 132. In this keep-alive arrangement, the plate 86 is provided with a slot 142, and plate 80 is provided with a column of holes 150. The slot 142 overlies and is aligned with the column of holes 150, and both lie beneath and are aligned with the A.C. electrode 140 so that, in effect, the electrode 140, slot 142 and holes 150 form a sandwich. The slot 142 in the plate 86 is narrower than the opaque A.C. electrode 140 so that a viewer, looking through face plate 30, cannot see any glow which is present in slot 142 and holes 150. Electrode 140 operates with plate 80 to produce glow discharge between them and produce excited particles in slot 142 and holes 150. These excited particles are available to the reset cathode 62 and assist the firing of the column of reset cells. A suitable tab 144 is provided for electrode 140.

Figure 3:
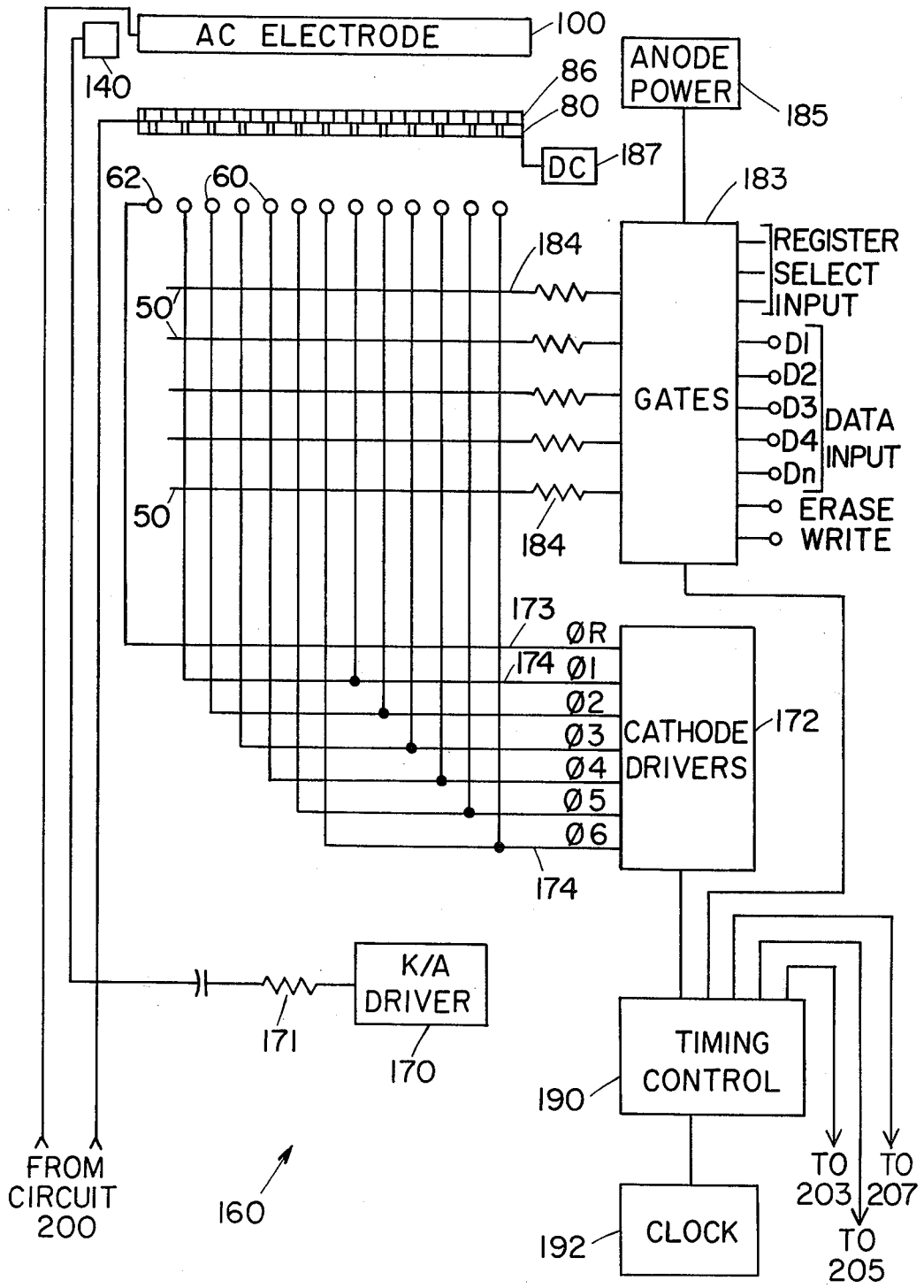
FIGS. 3 and 4 include a schematic representation of the panel of FIG. 1 and an electronic system in which it may be operated.
Figure 4:
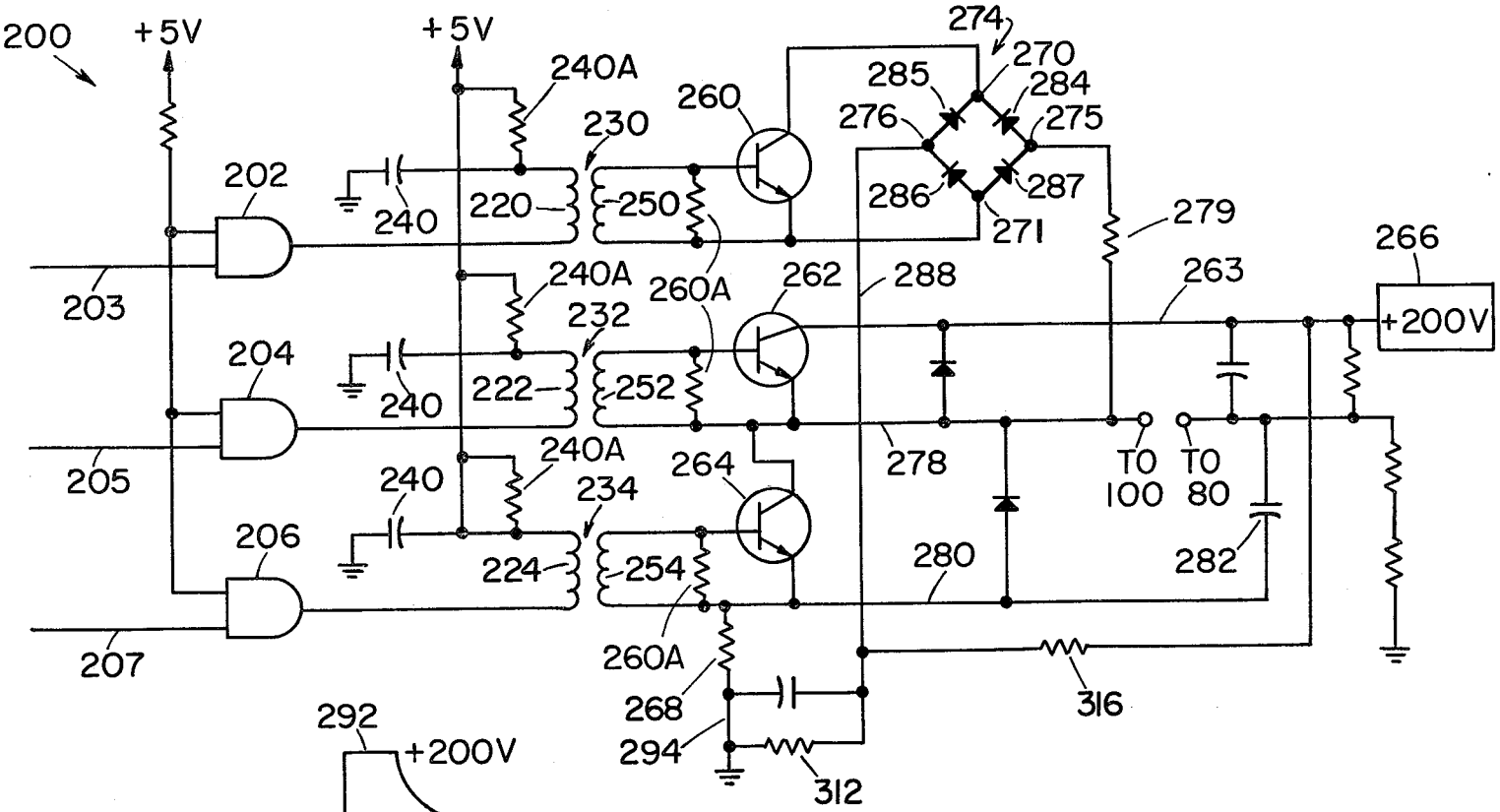

A schematic representation of the display panel 10 and an electronic system 160, according to the invention, for operating the panel are shown in FIG. 3. The circuit includes a keep-alive driver 170, which provides an A.C. signal, coupled through a resistor-capacitor circuit 171, to keep-alive electrode 140. The resistor-capacitor circuit prevents arcing in the keep-alive cells which are normally always fired. The system also includes module 172 which comprises a series of serially energizable drivers for providing a negative reset pulse for reset cathode 62 on lead 173 and a series of negative scan cathode pulses for cathodes 60 on leads 174. The scan cathodes 60 are connected in groups or phases ($\phi$) with each group including any suitable number of cathodes such as three or four or six, as desired. Grouping or phasing of cathodes in this way is now well known in the SELF-SCAN panel art. The scan phase drivers in module 172 are sequentially activated so as to energize each of the cathodes 60 in consecutive sequence across the "Y" axis of the panel.

A D.C. power source 185 is coupled through a gating module 183 and a resistive path 184 which connects the gating module 183 to each of the scan anodes 50. The inputs to the gating module 183 are data inputs D1 . . . Dn, erase and write control inputs, and register select inputs. As to the registration select inputs, normally the panel 10 includes several display registers, each register having its own row scan anodes, but with the column scan cathodes being common to all of the registers. Of course, the other panel electrodes 80, 86, and 100 are associated with all of the registers. In such a multi-register panel, the electronic circuitry selects the register, through the gating module 183, to which the various scan and display signals are applied. The gating module 183 thus is operated so that the data inputs are steered to selected groups of adjacent scan anodes or registers in accordance with the state of the register select inputs. The gating module 183, under control of the register select inputs, switches a positive D.C. potential from source 185 to the selected adjacent anodes 50, and, as each cathode driver in module 172, and each cathode 60, is energized, each column of scanning cells is energized, in the area of the selected anodes, and a cathode glow surrounds each cathode 60 in turn, in the area of the selected anodes.

A source 187 of D.C. bias potential is coupled to priming plate 80, and a source 200 of sustainer signals, to be described, is connected to the transparent conductive layer 100.

The data input signals are used to gate the write and erase pulses, which are generated in module 190, to certain selected display anodes to perform a display function. The write and erase operations are enabled or disabled by means of the write and erase control inputs to module 183.

A timing control module 190 is provided and coupled to all of the appropriate portions of the system 160, and a clock 192 is connected to the input of the timing control module which receives a clock input and generates the timing pulses for reset of the cathode drivers, for the timing pulses for the generation of the sustainer signals, and for the write and erase pulses which are synchronized, as required, to the appropriate segments of the sustainer signal. The data inputs are also synchronized by the timing control clock.

The detailed operation of the display panel 10 is described in the above-identified copending application and will not be repeated in as much detail here. A brief description of the operation of the invention and the panel is as follows. The keep-alive cells 140 are energized to provide a constant supply of excited particles of the reset cathode 62 for use at the beginning of a scanning cycle. This is achieved by applying pulses from source 170 to the keep-alive electrodes.

With the keep-alive apparatus thus generating excited particles, and with operating potential applied to the scan anodes 50, the reset cathode 62 is energized to fire the column of reset cells, and then the scan cathodes 60 are energized sequentially by operation of driver module 172 to carry out a scanning operation in the lower or scan portion of the panel 10. At the same time, with sustaining pulses applied from circuit 200 to the electrode 100, as each column of scan cells is energized, information or display signals are applied out of gate module 183 to the selected scan anodes to cause glow to develop in the associated display cells where it is sustained by the sustaining pulses. When all of the columns of scan cells have been energized and the appropriate associated display cells have been energized, a sustained message is present and visible in the upper portion of the panel, and the scanning section of the panel is made inactive.

Figure 5:
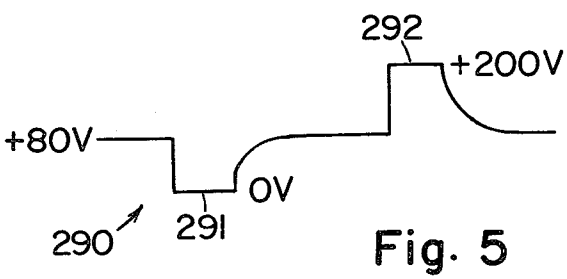
FIG. 5 is a respresentation of the waveform of sustainer signals generated by the circuit of FIG. 4 and applied to the display panel represented therein.

The system 160 of the invention includes circuit 200 for generating bipolar sustaining signals 290 (FIG. 5) to be applied across A.C. electrode 100 and electrode plate 80 in panel 10. The circuit 200 includes three AND gates 202, 204, 206, each having two inputs, one of which is connected to a bias voltage. The other inputs 203, 205, 207 are connected to the timing control module 190.

The output of AND gate 202 is connected to one end of the primary winding 220 of a pulse transformer 230, the output of AND gate 204 is connected to one end of the primary winding 222 of a pulse transformer 232, and the output of AND gate 206 is connected to one end of the primary winding 224 of a pulse transformer 234. The other ends of the primary windings are each connected through a capacitor 240 to ground and resistor 240A to the +5 volt supply. The secondary windings 250, 252, 254 of the transformers are connected between the base and emitter of transistors 260, 262, 264, respectively, and each base and emitter is shunted with a resistor 260A.

The collector and emitter of the transistor 260 are connected to opposite points 270 and 271 of a diode bridge 274, and third point 275 of the bridge being connected through resistor 279 to a lead 278 which itself is connected to electrode 100 in panel 10, and the fourth point of the bridge 276 being connected to reference voltage lead 288.

The diode bridge includes a diode 284, oriented as shown between points 270 and 275, a diode 285, oriented as shown between points 270 and 276, a diode 286, oriented as shown between points 276 and 271, and a diode 287, oriented as shown between points 271 and 275. Bridge point 276 is connected to lead 288 which is set at the reference voltage of 80 volts by connection of lead 288 through a voltage divider and lead 294 to lead 263. Resistors 312 and 316 comprise a voltage divider.

The collector of transistor 262 is connected by lead 263 to a source of positive D.C. potential (200 V) represented by reference numeral 266 which is the maximum voltage of the sustaining signals used herein, and the emitter of transistor 262 is connected to lead 278 and thus to the electrode 100. The third transistor 264 has its collector connected to the lead 278 and thus to electrode 100 and its emitter connected to lead 280 which itself is connected through capacitor 282 to plate 80 in the panel 10. Lead 280 is also connected through a resistor 268 to ground. Resistor 268 serves to dissipate high spike currents resulting from the high switching currents at the output of transistor 264, and it prevents them from getting into the low voltage signal ground.

The circuit 200 generates unusually high peak current sustainer signals 290 (8 to 10 amperes) at lead 278, these signals having multi-level voltage transitions to drive the display cells of panel 10 and sustain glow therein. The sustaining signals 290 include positive and negative pulse excursions between 200 volts and zero volts about an 80 volt reference bias level. Other operating voltages may also be used where suitable, if desired.

In generating the sustaining signals 290, first AND gate 206 receives a pulse from timing control circuit 190 and its output, operating through transformer 234, turns on transistor 264. Transformer 234 performs signal level shifting and provides base current to turn on transistor 264 and a low base impedance to assist in the turn-off of transistor 264. The turn-on of transistor 264 generates the negative-going pulse 291 at lead 278 which reaches a level of about zero volts.

After the desired time duration for pulse 291, AND gate 202 receives a turn-on pulse which operates through transformer 230, like transformer 234, to turn on transistor 260, and this generates current flow through the diode bridge 274 to return the sustaining pulse to the 80 volt level. Next, AND gate 204 receives a turn-on pulse, and its output turns on transistor 262 which generates the positive pulse 292 of the sustaining signal to a level of about 200 volts. Finally, AND gate 202 receives another pulse to turn on transistor 260 again to generate the negative-going portion of the sustaining signal back to the 80 volt level by way of the diode bridge 274.

It is noted that transistor 260 performs a dual function in switching the sustaining signal either from 200 volts to the reference level of 80 volts or from zero volts to the reference level of 80 volts. The positive or negative transition of the switching operation of transistor 260 is determined by the sustain output voltage level prior to switching and the resultant path through the diode bridge 274. If the sustain output level is at 200 volts, the turn-on of transistor 260 will cause the sustain output to switch in a negative direction to 80 volts due to the low impedance path to the 80 volt bus 288 by way of resistors 279, diode 284, transistor 260, and diode 286. Diodes 285 and 287 are open circuited. Likewise, if the sustain output level is at zero volts, the turn-on of the transistor 260 will cause the sustain level to switch in a positive direction along a low impedance path to the 80 volt bus 288 by way of resistor 279, diode 287, transistor 260, and diode 285, with diodes 284 and 286 being open circuited.

It is noted that the transitions from 80 volts to zero volts and from 80 volts to 200 volts are associated with visible discharges in fired display cells 94 in panel 10, and, as a result, transistors 262 and 264 must be capable of driving peak current pulses of 8 to 10 amperes at relatively low saturation voltage and relatively high switching speeds. The other signal excursions of the sustain waveform 290 occur when display discharge does not occur, and therefore transistor 260 is not required to provide the high speed, high current drive demanded of transistor 262 and 264. Resistor 279 is placed in series with the collector of transistor 260 to dissipate a portion of the power expended in the switching function, thereby allowing transistor 260 to be a lower power, less expensive device than transistors 262 and 264.

What is claimed is:

1. A system for operating a display panel with memory wherein the display panel includes a gas-filled envelope, a first layer of D.C. scan cells disposed in rows and columns and including row scan anodes and column scan cathodes which cross each other, with the crossings defining said D.C. cells, an apertured electrode defining rows and columns of display cells, each display cell being in communication with a D.C. scan cell, and an A.C. electrode associated with and insulated from said apertured electrode and operating therewith as the electrodes for said display cells, said system comprising first means coupled to all of said scan anodes for applying operating potential thereto, second means coupled to said scan cathodes for applying operating potential to each cathode in turn to fire and turn on each column of scan cells in turn sequentially, third means coupled to said scan anodes for applying data signals to selected ones of said anodes as its column of scan cells is fired and turned on, and fourth means coupled to said apertured electrode and said A.C. electrode for applying sustainer signals thereto, the application of said sustainer signals and said data signals being synchronized so that, when the data signals are applied, glow is generated in the selected display cells associated with the scan anodes to which the data signals are applied, the sustainer signals sustaining the display glow in such selected display cells, said fourth means comprising an electronic circuit including means generating a sustainer signal including positive and negative pulses generated about a positive reference voltage level, said means including a diode bridge and a plurality of semiconductor switches coupled thereto so as to provide said sustainer signal as each semiconductor switch is turned on in an operating sequence.

2. The system defined in claim 1 wherein said means in said fourth means includes a first semiconductor switch which operates through said diode bridge to generate a negative pulse, a second semiconductor switch which operates through said diode bridge to terminate said negative pulse and generate the positive-going portion thereof, and a third semiconductor switch which generates a positive pulse, said second semiconductor switch operating through said diode bridge to generate the negative-going portion of said positive pulse to complete the sustainer signal.

3. The system defined in claim 2 and including a timing control circuit coupled to each of said semiconductor switches for controlling the sequential operation thereof to produce said sustainer signals.

4. The system defined in claim 2 and including a timing control circuit coupled through a transformer to each of said semiconductor switches for controlling the sequential operation thereof to produce said sustainer signals.

* * * * *